US008662795B2

(12) United States Patent
Saccani

(10) Patent No.: US 8,662,795 B2
(45) Date of Patent: Mar. 4, 2014

(54) HEAD FOR INJECTING CONSOLIDATING PRESSURISED FLUID MIXTURES INTO THE GROUND

(75) Inventor: Cesare Saccani, Bologna (IT)

(73) Assignee: Trevi S.p.A., Cesena, Forli-Cesena (IT)

( * ) Notice: Subject to any disclaimer, the term of this patent is extended or adjusted under 35 U.S.C. 154(b) by 272 days.

(21) Appl. No.: 13/181,116

(22) Filed: Jul. 12, 2011

(65) Prior Publication Data

US 2012/0012400 A1 Jan. 19, 2012

(30) Foreign Application Priority Data

Jul. 15, 2010 (IT) ..... TO2010A0613

(51) Int. Cl.
*E02D 3/12* (2006.01)

(52) U.S. Cl.
USPC ..... 405/269; 405/266; 405/267; 175/424; 175/323; 175/324

(58) Field of Classification Search
USPC ..... 405/258.1, 266–269; 175/21, 67, 424, 175/323, 324
See application file for complete search history.

(56) References Cited

U.S. PATENT DOCUMENTS

| | | | | |
|---|---|---|---|---|
| 5,228,809 | A | 7/1993 | Yoshida et al. | |
| 6,648,084 | B2 * | 11/2003 | Morey et al. | 175/67 |
| 7,000,714 | B2 | 2/2006 | Gessay et al. | |

FOREIGN PATENT DOCUMENTS

| | | | |
|---|---|---|---|
| EP | 1 396 585 | A1 | 3/2004 |
| JP | 2002-121987 | A | 4/2002 |
| JP | 2008-285811 | A | 11/2008 |
| WO | WO 02/01043 | | 1/2002 |
| WO | WO 03/006785 | | 1/2003 |

OTHER PUBLICATIONS

Extended European Search Report for corresponding European Patent Application No. 11173751.6-2303 mailed Oct. 26, 2011.

* cited by examiner

*Primary Examiner* — Sean Andrish
(74) *Attorney, Agent, or Firm* — Merchant & Gould P.C.

(57) ABSTRACT

A head includes an outer cylindrical body with at least one upper inlet for fluids, at least one outlet side nozzle and at least one helical duct having a helical central line. The duct connects the upper inlet to the nozzle and imparts the fluid flowing through it a helical motion about the longitudinal axis of the outer body towards the nozzle. The helical duct is progressively tapered towards the nozzle and includes a terminal length of the duct which is radiused to the nozzle in a tapered manner, both when viewed in cross-sectional planes parallel to the longitudinal axis and tangent to the helical central line, as well as when viewed in cross-sectional planes perpendicular to the longitudinal axis.

11 Claims, 7 Drawing Sheets

25
25d
25c 25e
25b
25c
25a
25d
25

25e
25a
25

21
20
14b
14a
14c
14b
25
18

24
22
18
24

17
14b
25
26
VII
26
26
VII
11
18
26

18
17
25
25
18

HEAD FOR INJECTING CONSOLIDATING PRESSURISED FLUID MIXTURES INTO THE GROUND

This application claims benefit of Serial No. TO2010A000613, filed 15 Jul. 2010 in Italy and which application is incorporated herein by reference. To the extent appropriate, a claim of priority is made to each of the above disclosed applications.

The present invention relates to a high-efficiency head for injecting consolidating pressurised fluid mixtures into the ground in order to form consolidated soil portions.

BACKGROUND ART

The techniques known as "jet grouting" are used to form columnar structures of artificial conglomerate in the ground. These techniques are based on the mixing of particles of the soil itself with binders, usually cement mixtures, which are injected at high pressures through generally small radial nozzles formed in an injection head (commonly referred to as a "monitor"), fixed in the proximity of the lower end of a string of tubular rods which is rotated and withdrawn towards the surface. At the bottom of the string of rods, under the monitor, there is fixed a drilling tool which is lubricated, during the excavation phase, with a drilling fluid supplied through the rods, which, in this case, act as ducts.

The jets of binder are dispersed and are mixed with the surrounding soil, thus creating a conglomerate block, generally of cylindrical shape, which, when hardened, forms a consolidated area of soil.

The strings which are presently most commonly used in the foundations sector have a duct with a large cross-section through which the mixture of water and cement is supplied to the monitor zone, where the nozzles are present. The latter are housed in radially oriented holes, i.e. perpendicular to the longitudinal axis of the monitor. In terms of fluid dynamics, this configuration reduces the friction losses along the path, since the flow velocity of the fluid is low so long as the fluid does not reach the end of the monitor. Once the fluid has reached this zone, the stream deviates orthogonally in the region of the nozzle, also creating irregular free motions characterised by strong turbulence in the region in which the stream deviates. This brings about a high head loss, right in the proximity of the outlet from the nozzles, as a result of turbulence which prevents the stream from exiting the nozzles in an ordered manner, i.e. with the velocity vector of the single particle of material exiting oriented according to the main axis of each nozzle.

The procedures by which the fluid passes from the inside to the outside of the monitor are the cause of considerable head losses and are therefore understood not just in terms of increased power consumption but also in terms of a reduced diameter of the column of treated material. There is thus a need in the field to limit the head losses generated within the monitor.

The patent literature discloses various monitors for the jet grouting sector which, in their interior, have a plurality of channels that are twisted according to a layout with multi-helical geometry and are able to guide the stream in a helical motion from the inlet of the monitor to the inlet of the relative nozzle. One example is given by JP-A-2008285811. This type of multi-helical geometry does not guarantee per se the maximum improvement in performances with respect to the conformation usually used (i.e. that which generates a turbulent free motion), unless the fundamental parameters for the correct dimensioning of said structure are identified and the inlet and outlet zones of the jet are modified so as to maximise efficiency.

The patent literature also describes other monitors having one or more curved ducts for deviating the fluid mixture, conveying it from the main duct towards the side nozzles, following paths with gradual changes in direction, thereby reducing the turbulences and the concentrated head losses. U.S. Pat. No. 5,228,809 discloses a duct with a constant cross-section and regular curvature. EP-1396585 discloses progressively tapered, variable curvature ducts. However, the diameter of the ducts for the passage of the fluid mixture along the entire final inlet length to the nozzles is conditional on the need to balance two opposing requirements: firstly, it is necessary to limit the external dimensions of the monitor (generally relatively small and of the order of magnitude of about 100 mm); secondly, it is desirable to give the ducts the best radius of curvature possible. In other words, these systems provide a length which has an appreciable length and a reduced diameter and is comparable to that of the outlet for the nozzle. Therefore, the advantage derived from the reduced concentrated losses is limited by the fact that the fluid adopts a very high velocity within the final length, with very high resulting friction losses. In addition, the presence of ducts, curves and radiuses greatly complicates the overall architecture of the monitor, making the assembly, maintenance and disassembly steps much more complex.

SUMMARY OF THE INVENTION

The main object of the invention is to provide a monitor or injection head having the greatest possible efficiency in terms of penetrative capacity of the jets leaving the monitor, to be more precise to obtain a greater disintegrating effect on the soil to be treated, with the power consumption remaining the same.

This and other objects and advantages, which will be understood more fully from the text which follows, are obtained according to the invention by an injection head or monitor having the features set forth in the appended claims. In brief, the head includes an outer cylindrical body with at least one upper inlet for fluids, at least one outlet side nozzle and at least one helical duct having a helical central line. The duct connects the upper inlet to the nozzle and imparts the fluid flowing through it a helical motion about the longitudinal axis of the outer body towards the nozzle. The helical duct is progressively tapered towards the nozzle and includes a terminal length of the duct which is radiused to the nozzle in a tapered manner, both when viewed in cross-sectional planes parallel to the longitudinal axis and tangent to the helical central line, as well as when viewed in cross-sectional planes perpendicular to the longitudinal axis.

BRIEF DESCRIPTION OF THE DRAWINGS

A preferred but non-restrictive embodiment of the invention will now be described with reference to the appended drawings, in which.

DETAILED DESCRIPTION OF PREFERRED EMBODIMENTS

Before providing a detailed description of a preferred embodiment of the invention, the text hereinafter states the criteria which were carried out in order to achieve the invention and which are all based on the search for the maximum efficiency of the jet. In this respect, an energy analysis was carried out on the fluid stream in motion in the monitor, analysing the head losses. The following have emerged from these analyses, in view of the conditions imposed by the architecture of the monitor:

- inlet of the stream predominantly vertically or parallel to the axis of the monitor,
- outlet of the stream predominantly orthogonally with respect to the axis of the monitor, and
- the presence of a central duct, within the monitor, which is to be left free for the passage of the cooling fluid from the head of the rod, the path which the fluid has to take within the monitor in order to obtain the greatest possible efficiency (or the minimum head loss) is a helical path. It is thereby possible, in fact, to continuously deviate the direction of the stream, and it is also possible to continuously vary the cross-section and the hydraulic diameter of the duct, which determines the helical path. In this context, "path" refers to the geometrical location of the points which specifies the centre of the cross-sections of the duct orthogonal to the stream of fluid within the monitor. In other words, the path coincides with the central (helical) line of the duct, as described in detail hereinbelow. It is clear that not all of the helical paths are able to produce the desired effect in terms of minimising the losses. To this end, i.e. to minimise the head losses on account of the passage through the monitor itself, it has been found that the optimum helical path which the fluid has to take is specified by five conditions for minimising the losses, as described hereinbelow.

Figure 1:
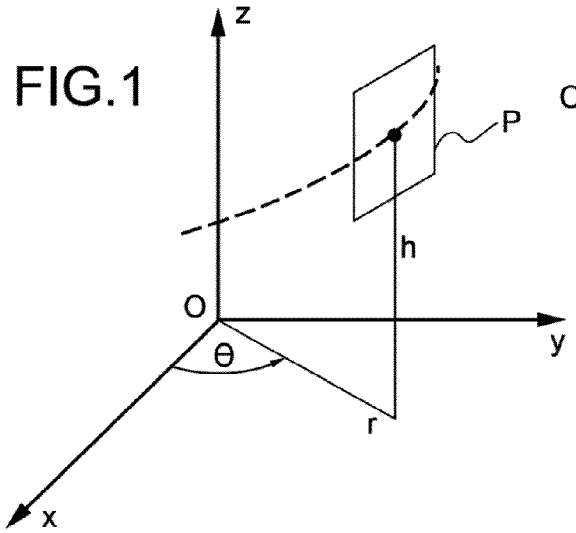
FIGS. 1, 1A and 2 are illustrative diagrams showing the geometrical form of a helix.

With reference to FIG. 1, the equation of a generic helical path is defined in the following components:

$$x=r(\theta)\cos\theta$$

$$y=r(\theta)\sin\theta$$

$$z=h(\theta),$$

where r(θ) and h(θ) are functions of the angle θ, variable within a range between the values θ1 (inlet of the monitor) and θ2 (angular value at the outlet nozzle).

Figure 2:
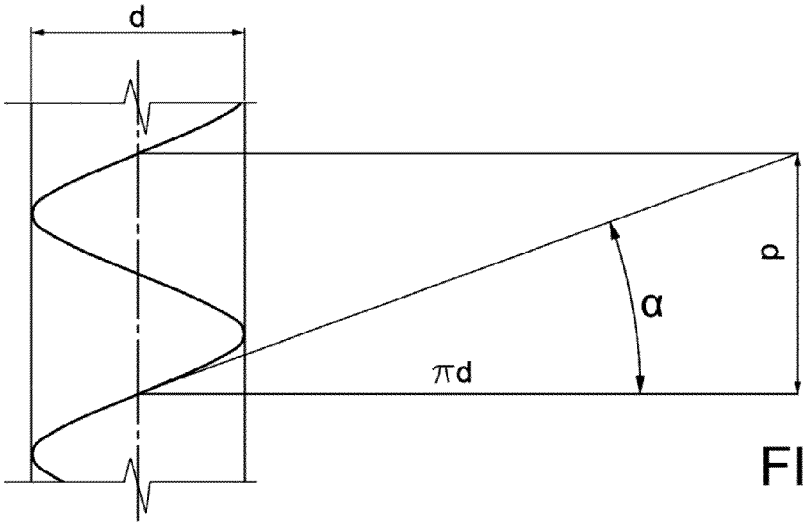

The first condition for minimising the losses is that the radius r of the helical path ideally remains constant. In some cases, this is not possible for design reasons; the radius, though, has to vary linearly between the inlet and the outlet of the monitor. Arbitrarily setting the lower limit of the range in which the angle θ lies to zero (that is θ1=0) implies that the variable to be determined will instead be θ2 or, in an equivalent manner, the height of the monitor, understood to be the distance on the axis of the monitor between the inlet and the outlet of the monitor itself. Regarding the function h (θ), the following relationship would be present in the case of a helix with a constant pitch (references in FIG. 2).

$$\text{pitch } p=z(\theta=2\pi)=h2\pi$$

(where h has a constant value of greater than zero)

$$tg\alpha=h/r$$

$$z=h\theta=rtg\alpha\theta$$

The condition of a constant pitch is in fact not verified in the example shown here, since there is a variation in the angle α of the helical path present between the inlet (α≈90°) and the outlet of the monitor (α≈0°).

The second condition for minimising the losses is as follows: the function which expresses the variation in the angle α of the helical path between the inlet and the outlet of the monitor has to be linear; in other words, the function which expresses the variation in the angle α of the helix along the path has a constant derivative.

The angle α at the inlet cannot be set to be equal to 90° since an infinite value of the derivative corresponds to this angle value. It is therefore necessary to radius the inlet of the monitor so as to deviate the stream into an almost vertical direction, which differs by a quantity Δ from the strictly vertical direction so as to minimise the losses (third condition for minimising the losses). By way of example, a value known from the literature for a conical inlet with small concentrated losses is that of a radius angle Δ equal to 20°, which corresponds to a real inlet at the inlet of the fluid (start of the path) with an α value equal to 70° (i.e. 90°-20°), which produces small concentrated head losses. If the derivative of the function which describes the variation of the angle of the helical path α is constant with respect to θ, it follows that this function will be linear, considering the constrained conditions at the ends, i.e. of the following type:

$$\alpha=a+b\theta=(\pi/2-\Delta)(1-\theta/\theta_2)$$

At this point, it is necessary to deduce the link between z and the tangent of α. The quantity increase dz, which differs on each point of the helical path, due to the variability of α along the path itself, that is as a function of θ, is given by the following:

$$dz=rtg\alpha d\theta$$

from which, by integration, the value of z associated with each value of θ is obtained.

$$z=\int rtg\alpha d\theta=-r/b[\ln|\cos\alpha|-\ln|\cos a|]$$

A number of decisive relationships for specifying the optimum path have been established from the known equation for calculating the losses of head of fluids in motion in ducts and drawing on the technical literature; in particular, reference is made to the relationship which exists between the variation in cross-section (or in the square of the hydraulic diameter) and the corresponding coefficient of concentrated loss relative to the abrupt cross-sectional variation.

It is observed that, with a variation in cross-section (or in the square of the hydraulic diameter) present between the inlet and the outlet of the monitor, the function S which expresses the decrease in the cross-section (or the function D which expresses the decrease in the square of the hydraulic diameter) between the inlet and the outlet of the monitor have to be linear, i.e. have a constant derivative (fourth condition for minimising the losses).

Figure 3A:
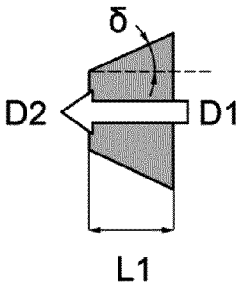
FIGS. 3A and 3B show schematic views of two converging ducts.
Figure 3B:
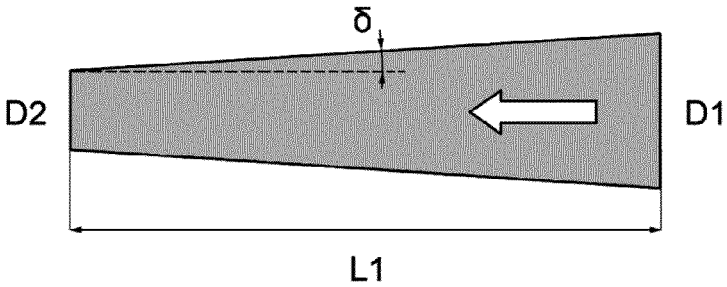

A further observation derives from the study of the head losses in converging ducts. If the hydraulic diameter is known at the inlet and at the outlet of the monitor, the linear development of the path shows that, depending on the value of the opening half-angle of the converging duct thus designed, it is possible to obtain a very short path (L1 in FIGS. 3A and 3B), which entails greater concentrated losses on account of the abrupt cross-sectional variation, or a very long path (L2 in FIGS. 3A and 3B), which instead entails greater friction losses caused by the friction on the walls, but concentrated losses which are small for the modest extent of the angle δ.

It is known from the technical literature that, in order for the head losses to be substantially small, the optimum half-angle δ by which the duct is tapered has to stay comprised between 5° and 15°; it is therefore possible to define a range within which it is possible to vary the value of the length L, which renders the path substantially optimised (fifth condition for minimising the head losses).

When designing the monitor, the first choice relates to the maximum admissible value of the tapering angle δ (i.e. 15°) for realising the smallest possible path without generating considerable concentrated losses. A posteriori, the feasibility of the choice made will be verified inasmuch as it is possible to verify intersections between the passage cross-sections of the duct between consecutive pitches of the helicoid and it is also possible to detect a thickness between the passage cross-sections of the duct between consecutive pitches of the helicoid which is less than the minimum thickness, which is a function of the working pressure of the fluid in motion within the monitor. Therefore, it is necessary to resort to a process of the iterative type, which specifies the maximum value of δ which is compatible with the design requirements.

The five conditions explained above are adequate for analytically determining the equation of the helicoid which minimises the head losses within the monitor. The analytical determination of the path of the helicoid is followed by the "construction" of the duct, understood to be the point by point application of a corresponding value of the area of the passage cross-section on the path, meaning the cross-section oriented at every point of the path of the helicoid orthogonally thereto.

The equation for the optimum path (in the above understanding) is therefore defined by the following relationships:

$$x=r\cos\theta \quad (1)$$

$$y=r\sin\theta \quad (2)$$

$$z=-r/b[\ln|\cos\alpha|-\ln|\cos a|] \quad (3)$$

$$\theta\epsilon[0;\theta_2] \quad (4)$$

$$r=\text{cost} \quad (5)$$

$$\alpha=(\pi/2-\Delta)(1-\theta/\theta_2) \quad (6)$$

$$a=\pi/2-\Delta \quad (7)$$

$$b=-(\pi/2-\Delta)/\theta_2 \quad (8)$$

$$L=\int(dx^2+dy^2+dz^2)^{0.5}=(D_1-D_2)/[2tg\delta] \quad (9)$$

If the inlet cross-section S1, the hydraulic diameter D1 and the radius r (which correspond in fact to the reference construction variables) are known, it is necessary to set a value for the parameters Δ and δ. In particular, the choice of the angle δ is verified at the end of the first calculation and may require an iterative process. Once these conditions have been defined, it is possible to deduce the missing variables as a function of the hydraulic diameter $D_2$, which in fact will coincide with the real diameter of the nozzle. In fact, the fixing of $D_2$ is equivalent to determining, by means of equation (9), the value of the length L of the helix. The value of $\theta_2$ is obtained from the resolution of the definite integral, again by equation (9). It is possible to reconstruct the path of the helix from equations (1), (2) and (3).

In summary, therefore:

- the area of the passage cross-sections decreases linearly, or with a constant gradient;
- the square of the hydraulic diameter of the passage cross-sections decreases linearly, or with a constant gradient;
- the length of the path is defined if the hydraulic diameter at the inlet $D_1$ and at the outlet $D_2$ is known;
- the radius of the helix which defines the path is preferably constant; if this should not be possible for design reasons, it has to vary linearly between the inlet and the outlet of the monitor;
- the variation of inclination α of the helix which defines the path is linear, or the function which expresses the variation of α with respect to θ has to have a constant gradient; the inlet of the monitor has a radius of constant cross-section in which the incoming stream is deviated by an amount Δ (of between 5° and 30°, for example 20°) with respect to the vertical direction;
- the pitch of the helix which defines the path decreases between the inlet and the outlet of the monitor;
- the duct radiuses both the stream arriving at the monitor with the inlet in a predominantly axial direction of the monitor and also the stream leaving in a predominantly radial direction of the monitor with the inlet of the nozzle, where radiusing is to be understood to mean guiding without abrupt changes in cross-section or direction.

Figure 4:
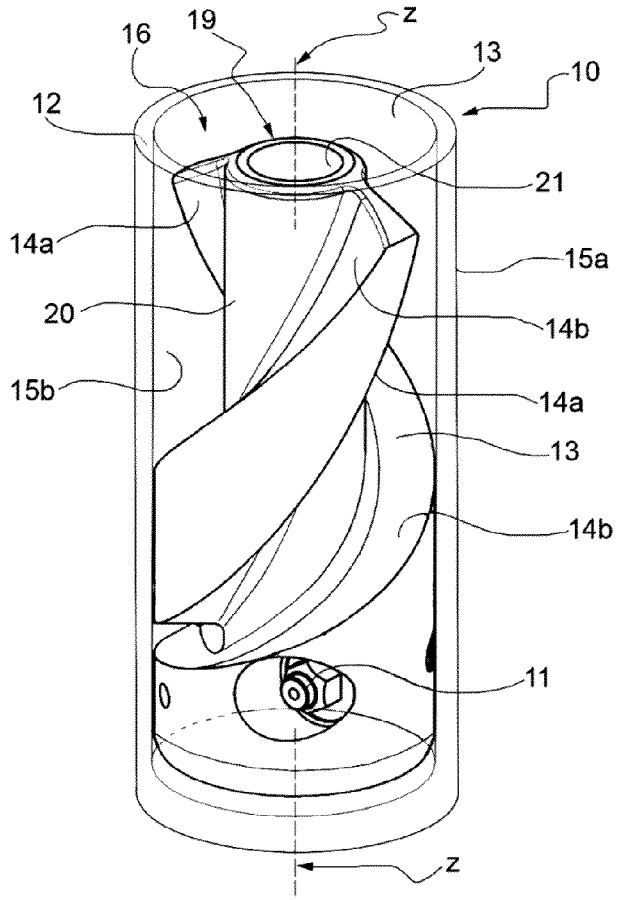
FIG. 4 is a schematic perspective view, in partially cutaway form, of an embodiment of an injection head or monitor according to the invention.
Figure 5:
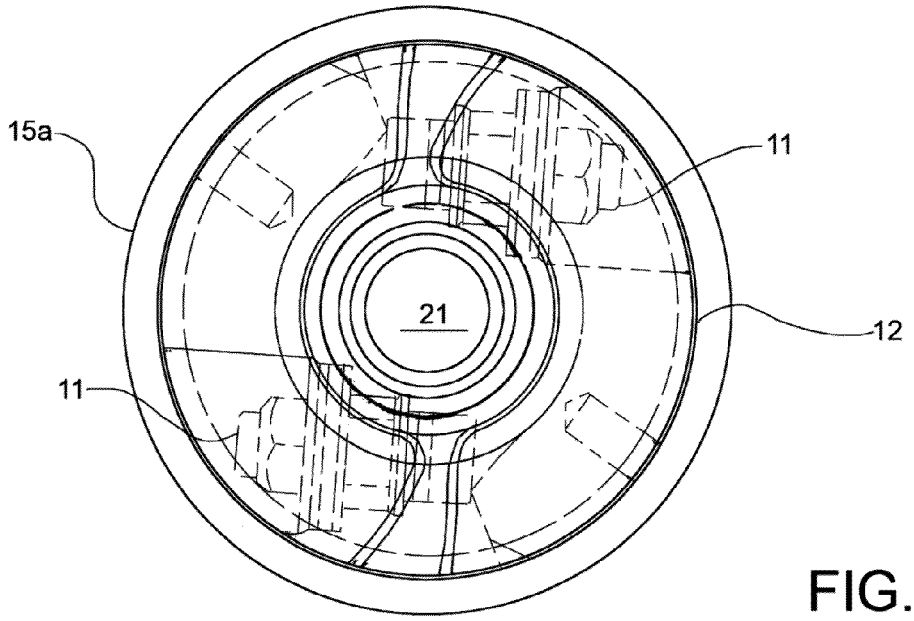
FIG. 5 is a schematic plan view, on a slightly enlarged scale, of the monitor shown in FIG. 4.

Referring, now, to FIGS. 4 and 5, an injection head or monitor is designated in its entirety at 10. The monitor comprises a bushing or outer sleeve 12 of a cylindrical tubular form having an outer cylindrical surface 15*a* and an inner cylindrical surface 15*b*. The monitor is used to deliver a pressurised jet of a consolidating fluid mixture, typically a concrete mixture, through one or more side nozzles 11 in order to break up the surrounding soil and consolidate it. The upper end of the monitor can be connected, in a manner known per se, to a string of tubular rods (not shown) in order to move the monitor in the vertical and rotate it about the central longitudinal axis z. In the present description and in the claims which follow, terms and expressions indicating positions and orientations, for example "longitudinal", "transverse", "radial", "upper" and "lower", are understood with reference to the central axis z and to a state of use in which the axis z is essentially vertical.

Figures 6, 7, 8, 9, 10A, 10B, 10C:
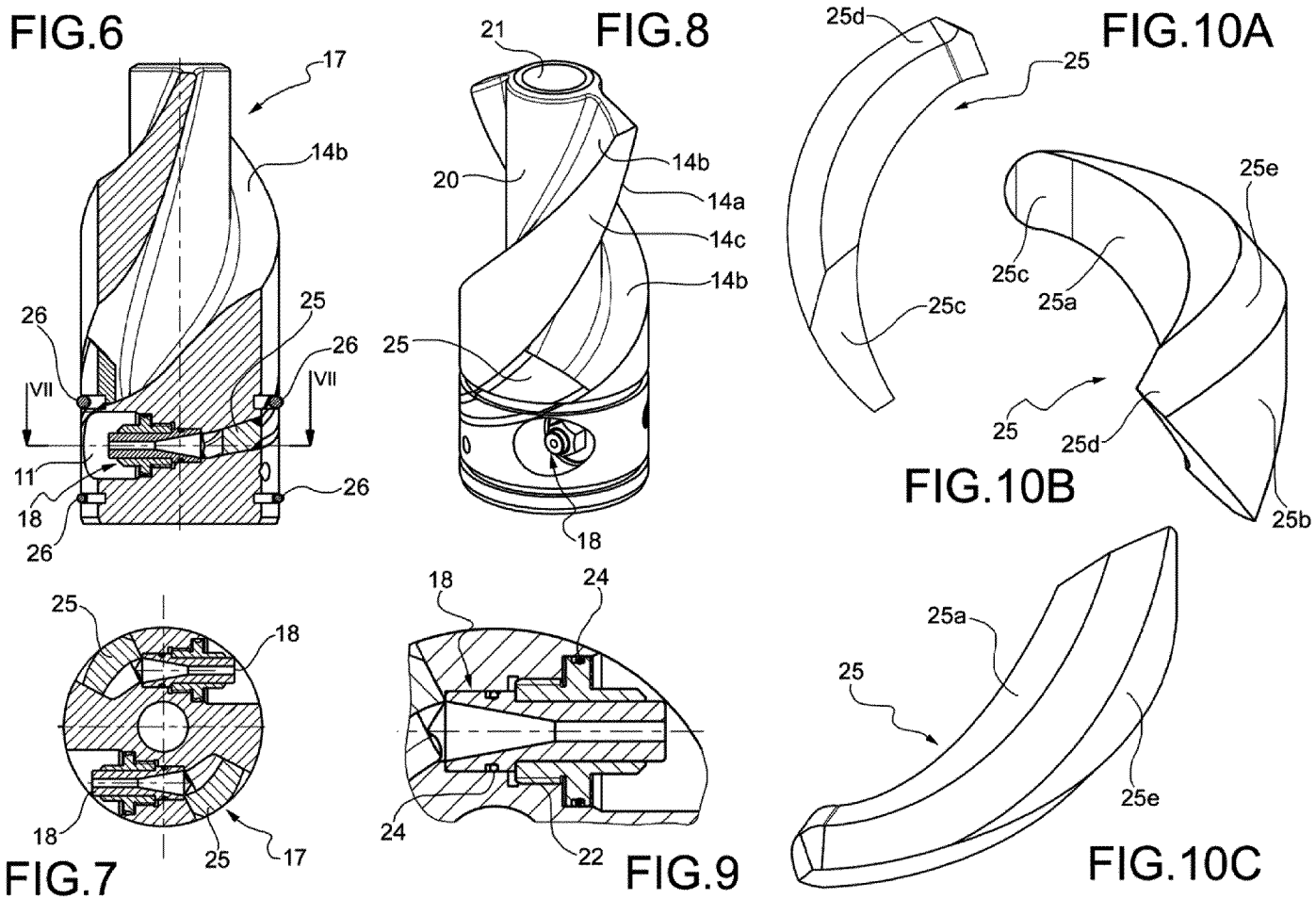
FIG. 6 is a view in axial section of a helical body incorporated in the monitor shown in FIG. 4.
FIG. 7 is a view in transverse section along the line VII-VII in FIG. 6.
FIG. 8 is a perspective elevated view of the component shown in FIG. 6.
FIG. 9 is a view, on an enlarged scale, of a detail shown in FIG. 6.
FIGS. 10A-10C are perspective views, from different angles, of the same component to be applied to the helical body shown in FIGS. 6 and 8.

The top of the monitor is provided with an inlet 16, through which a consolidating pressurised mixture to be delivered to the side injection nozzles is introduced. The side nozzles 11, of which there are two in the example shown in FIGS. 4 and 5, are oriented in substantially horizontal planes, i.e. perpendicular to the longitudinal axis z of the monitor, such as to direct the respective exiting jets in directions which do not pass through the axis z. The nozzles 11 are located in the proximity of the lower end of the monitor and are connected in fluid communication to the upper inlet 16 by means of respective helical ducts 13, which impart the fluid located in the inlet 16 a tangential component, which rotates the stream about the central longitudinal axis z of the monitor. In other words, the motion imparted to the fluid is of the helical type. The motion of the fluid is guided and confined laterally by the inner cylindrical surface 15*b* of the sleeve 12. The helical shape of each duct 13 is defined by a pair of facing helical surfaces, an upper one 14*a* and a lower one 14*b*, both formed by a rigid helical body 17 (FIG. 8), which is preferably metallic, secured at least temporarily within the cavity or inner cylindrical surface 15*b* of the sleeve 12. In the preferred embodiment, the helical surfaces 14*a*, 14*b* are "fluted" helicoids, generated by the helical movement of a straight line. Number 19 denotes a central tubular core, which is formed by said helical body 17 and has an outer cylindrical surface 20 and an axial central cavity 21 adapted for allowing the passage of a lubricating fluid for the drilling tip (not shown) mounted below the monitor. In this example, the transverse cross-section of the duct 13 is rectangular, being delimited at the top by the helical surface 14*a*, at the bottom by the helical surface 14*b*, externally by the cylindrical surface 15*b* and internally by the cylindrical surface 20. However, the invention is not intended to be limited to a duct with a rectangular cross-section; ducts of different cross-sections are possible, for example circular cross-sections or cross-sections which are radiused differently. The body 17, shown separately in FIGS. 6, 7 and 8, is preferably machined from solid by means of a machine tool, so as to obtain the helical channels which, together with the inner surface of the sleeve 12, define the ducts of the monitor.

Figure 1A:
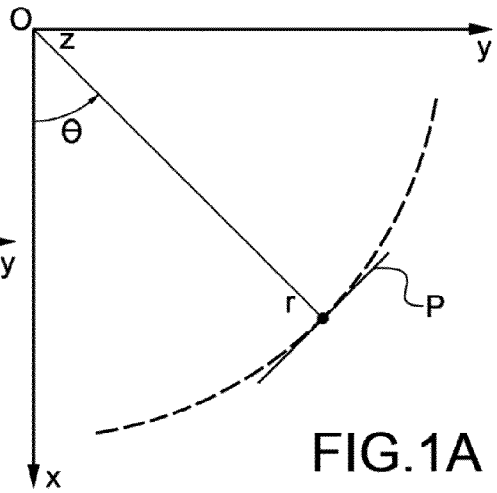

In all of the different embodiments described and shown here, the helical duct 13 is progressively tapered towards the respective nozzle 11 and includes a terminal length of the duct having a helical central line m (FIGS. 11 and 12); said terminal length is radiused to the nozzle in a tapered manner, both when said length is viewed in cross-sectional planes (indicated schematically by P in FIGS. 1 and 1A) parallel to the longitudinal axis z and tangent to the helical central line m, as well as when the terminal length is viewed in cross-sectional planes horizontal or perpendicular to the axis z.

On account of the helical shape of the ducts 13, the fluid located in the monitor follows a fixed helical path without being subjected to sudden variations in trajectory, thus minimising the creation of turbulences, or irregular components of the motion, with resulting energetic dissipations. Along the duct, the area of the cross-section that can be used for the passage of the fluid decreases linearly, or with a constant gradient; more particularly, as mentioned above, the square of the hydraulic diameter of the passage cross-sections decreases linearly, i.e. with a constant gradient, as far as the zone of the nozzles 11. The radius of the helix which defines the path of the ducts 13 remains substantially constant, whereas the inclination $\alpha$ of the same helix is reduced linearly in the direction of the nozzle; in other words, the pitch of the helix which defines the path is reduced linearly towards the discharge nozzle.

Compared with the conventional monitors discussed in the introductory part of the description, the greater cross-section of the monitor according to the present invention entails, with equivalent flow rate and pressure, clearly smaller head losses, or the minimum losses possible, given the helical geometry. As is known, the friction losses, in the case of incompressible fluid, are inversely proportional to the fifth power of the transverse dimension of the duct. Therefore, jets of an energy which is higher than that of the conventional monitors arrive at the monitor nozzles. As a result, the action of the jet grouting is more effective because, with an equivalent power being used, a column of consolidated soil having a greater diameter will be obtained.

In order to gain the maximum advantage in terms of performance, the nozzles are oriented according to tangents or secants with respect to the outer cylindrical surface of the monitor and in directions which match the direction in which the fluid advances, as indicated schematically in FIG. 5. The number, the typology and the inclination of the nozzles with respect to one or more horizontal planes (or planes perpendicular to the longitudinal axis of the monitor) can vary depending on the requirements. In the embodiment shown in FIG. 5, the jets of fluid leaving the nozzles 11 are oriented in opposite directions along two parallel straight lines.

The ability of the monitor to keep all the fluid streams together until the outlet nozzle drastically reduces the turbulences in the terminal part; this factor, together with the net reduction of distributed friction losses, contributes to an increase in the performance of the monitor compared to conventional monitors and to a maximisation of the hydraulic efficiency.

Each side nozzle 11 includes an insert 18 which is made of a wear-resistant material and has an inner funnel-shaped passage.

In the case of helical ducts 13 having a polygonal cross-section, such as the rectangular ducts in the example shown in FIG. 4, the terminal lengths in the proximity of the nozzles, which generally have a circular cross-section, comprise a deflector 25 (FIGS. 6, 7 and 8), shown separately in FIGS. 10A-C, which provides a gradual passage from the polygonal cross-section to the circular cross-section, in order to avoid localised head losses. The deflectors 25 create a polygonal inlet orifice and a circular outlet. These deflectors 25 can advantageously be made of a wear-resistant material like the inserts 18 of the nozzles, since the velocity of the fluid in this length is high, however, and therefore the erosive action is more pronounced. In the example shown in FIG. 8, the deflectors 25 are fixed on the structure 15*b* by welding. As an alternative, the monitor as a whole can be obtained by a precision casting or electroerosion process or using similar processes, and therefore the deflectors 25 can form a single piece with the helical surfaces. The half-angle $\delta$ is also between 5° and 15° in the inlet points of the radiusing deflectors 25.

The number 24 designates sealing elements which prevent leakage between the helical duct and the outlet of the nozzle. Indeed, on account of the very high pressure, the injection jet would not remain confined within the duct if there were a simple blow or a simple mechanical fit. This also occurs between the inner helical body 17 when it is inserted inside the sleeve 12. In this case, sealing elements are not inserted between the cylindrical edge 14*c* joining two helical surfaces (upper surface 14*a* and lower surface 14*b*), and the stream of injection material could leak from an upper coil pitch to the lower coil pitch (this would only occur, however, during the initial pumping step, when the monitor is not completely filled and adequately pressurised). In this executive assembled form, however, it is necessary to ensure that there is a seal between the inner helical body 17 and the inner cylindrical surface 15*b* of the sleeve 12. For this reason, at least one pair of gaskets 26 have been inserted above and below the nozzles, and guarantee that the fluid is sealed within the duct. In the absence of these gaskets, the injected material could leak and escape, brushing the surface 15*b*, with resulting problems in terms of liquid and pressure loss and inefficiencies in relation to the final erosive capacity of the jet.

In addition, as can be seen more clearly from FIG. 7, the thickness of the insert 18, which is likewise realised in a wear-resistant and replaceable material, means that it is expedient to radius the radially outermost side surface of the duct 13 to the inlet of the tapered passage produced in the insert 18. In other words, it is necessary to radius the inner cylindrical surface 15*b* of the sleeve 12 to the inlet of the insert 18. The deflector 25 is able to deviate progressively the fluid flow peripherally, adjacent to the surface 15*b*, towards a slightly more central zone, substantially in the direction of a chord passing through the axis of the nozzle. The deflector 25 has an outer cylindrical surface 25*b*, which is able to contact the surface 15*b* of the sleeve 12, and an arched inner surface 25*a*, which serves to deflect the flow. The deflector gradually increases in thickness, in such manner that the arched inner surface 25*a* starts from a thin end portion 25*c*, located more upstream in the duct 13, and terminates at the thicker end portion 25*d* located more downstream, at the inlet of the insert 18. The edges of the deflector can present bevels 25*e* for welding to the surface 15*b*. The deflectors 25 are expediently made of wear-resistant materials, for example Widia or tungsten carbide, or sintered materials, or else other materials.

Figure 11:
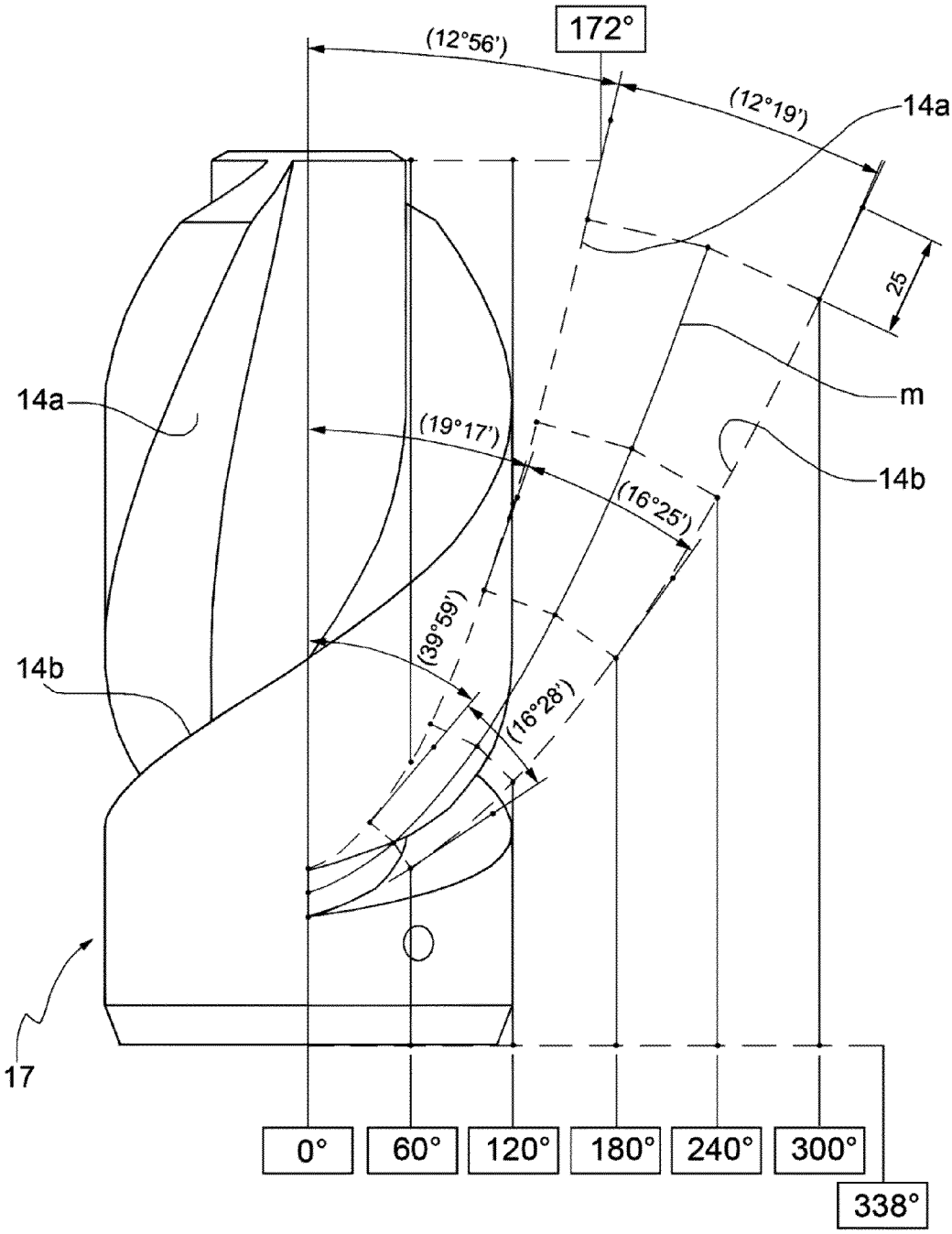
FIGS. 11 and 12 are diagrammatic views showing the plane development of an example of a helical duct within the monitor.
Figure 12:
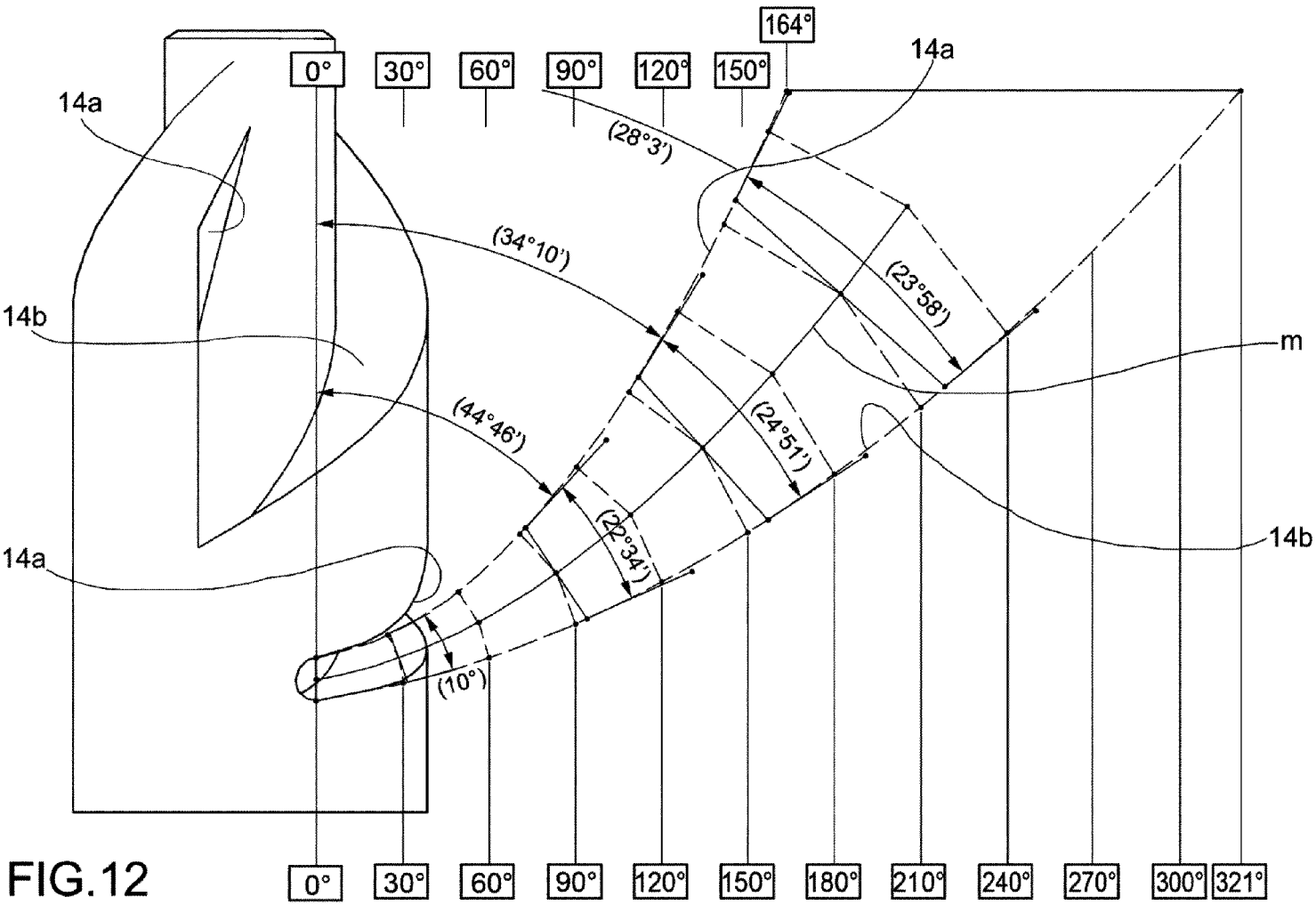
Figure 13:
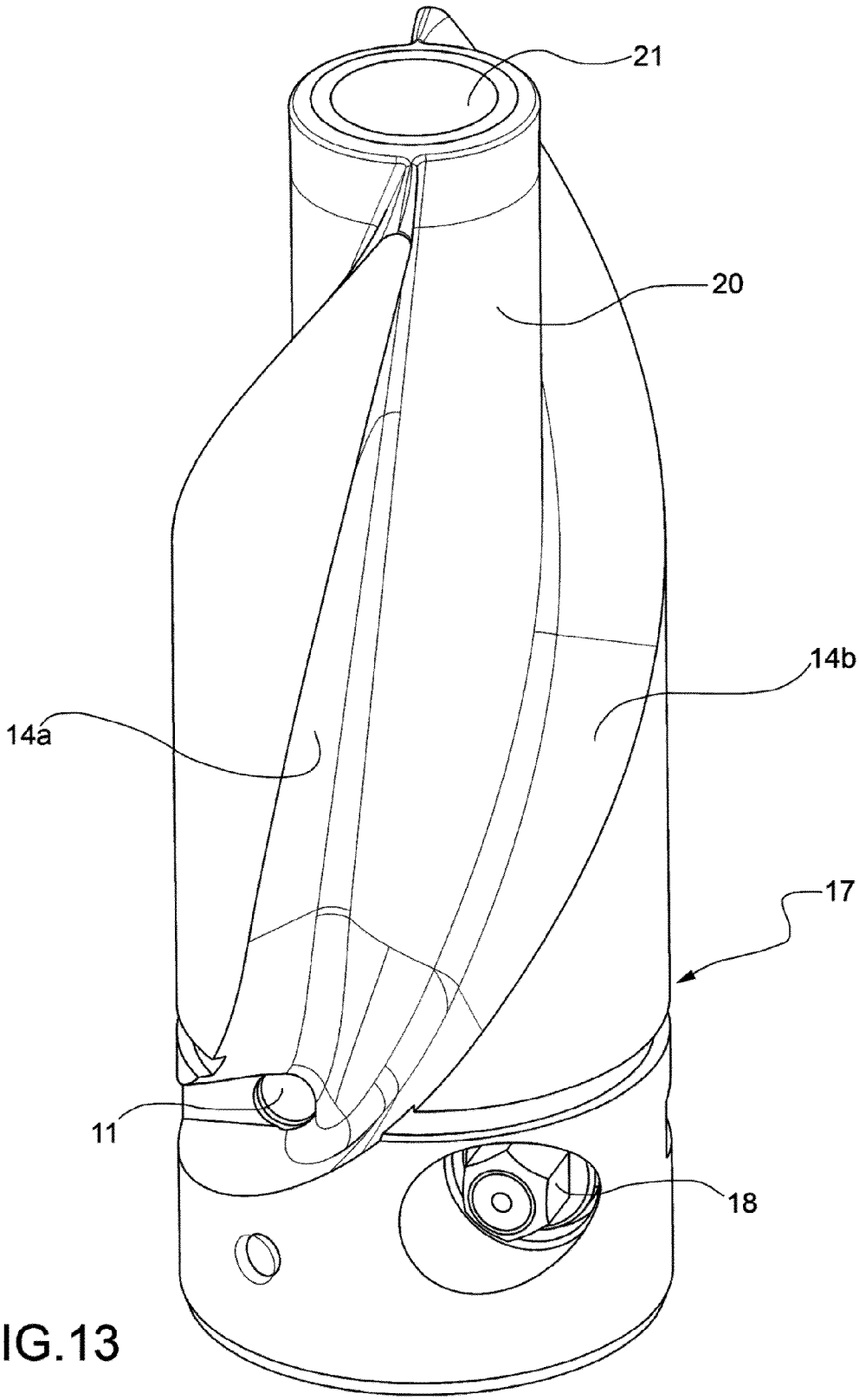
FIGS. 13 and 14 are perspective views of two different embodiments of a helical body located within the monitor.
Figure 14:
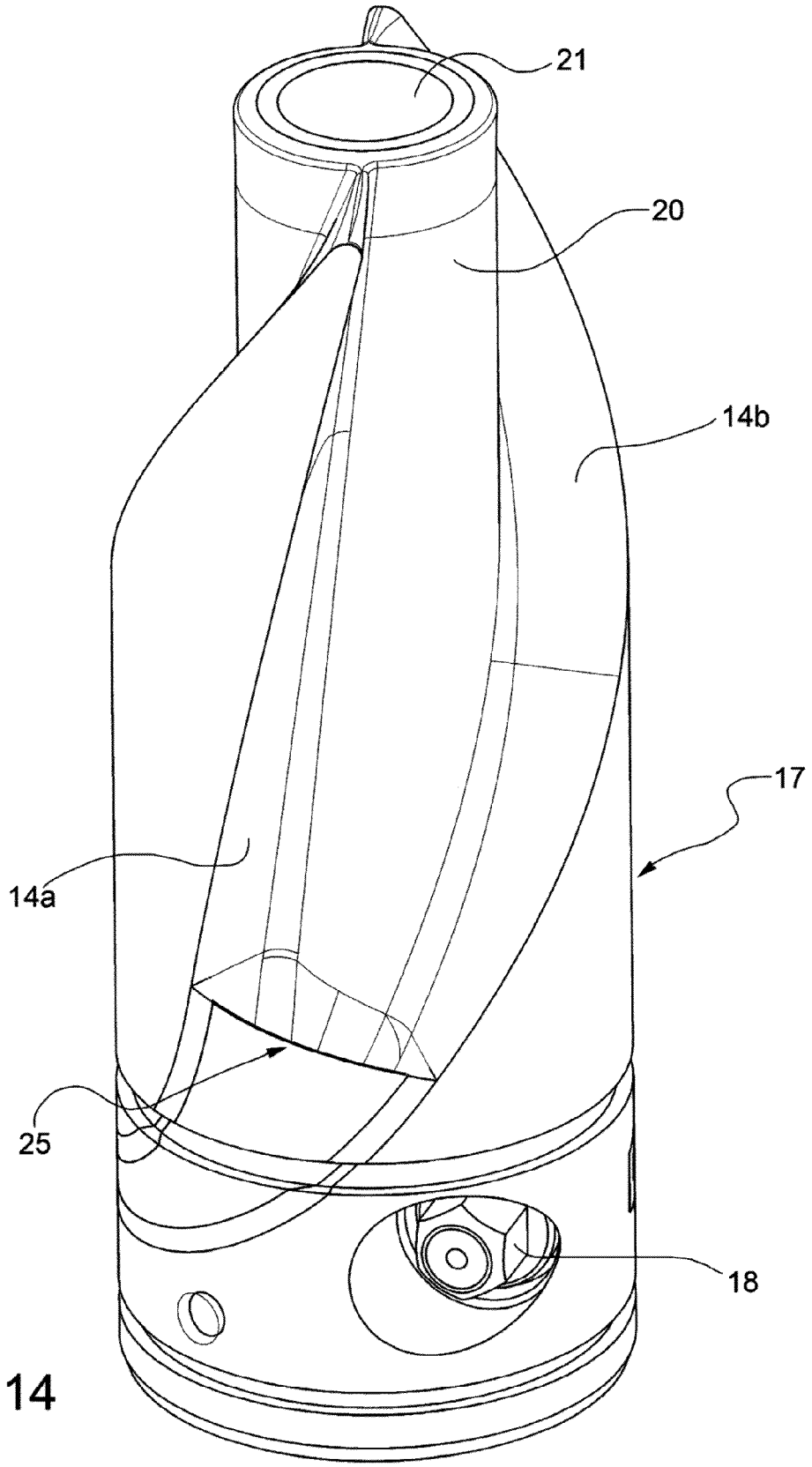

FIGS. 11 and 12 show the developments, in a vertical plane, of the vertical cross-sections of two examples of helical ducts 13; m denotes the central line of a helical duct 13. The abscissa plots the values of the angles measured in the horizontal plane proceeding from the angular value zero, which refers to a vertical plane passing through the central axis z of the monitor and through the lower point where the helical duct 13 terminates in the insert 18.

It is to be understood that the invention is not limited to the embodiments described and shown herein, which are to be considered as exemplary embodiments of the monitor; rather, the invention can be modified in respect of the form and arrangement of parts and details of construction, and in respect of its operation. For example, there may be one or more nozzles in the terminal length of each helical duct located at the same level or at different levels. In addition, for applications with double fluid jets (for example air—grout or water—grout), provision is made of an outer space suitable for feeding the air (or the water) to the outlet section of the nozzles, as is currently used with conventional monitors. In addition, these dedicated ducts may be used for the insertion thereinto of instruments or cables intended for the passage of information (data transmission) from the tool to the outside, and vice versa. Finally, it is possible to form two or more monitors of this type (a single fluid monitor and a double fluid monitor) to carry out triple fluid jet grouting treatments.

With respect to the form of the helical duct, it has already been mentioned that this depends on the design conditions, and these techniques are more or less expedient depending on the number of monitors produced. It is thereby possible to go from the form described, which is realised in one piece with a predominantly polygonal transverse cross-section, for a limited number of pieces, to a form obtained by casting or electroerosion, in which the duct could be realised in a form much closer to the optimum theoretical form, with ample radiusing in the inlet and outlet of the monitor.

What is claimed is:

1. A head for injecting consolidating pressurised fluid mixtures into the ground to form consolidated soil portions, the head comprising:

an outer cylindrical body defining a central, longitudinal axis;

an upper inlet for receiving fluids from a string of tubular rods mountable above the head;

a side outlet nozzle lying in a plane substantially perpendicular to the longitudinal axis;

a helical duct defining a helical central line, the helical duct connecting the upper inlet to the nozzle to impart the fluid flowing through the helical duct a helical motion about the longitudinal axis towards the nozzle;

wherein the helical duct is progressively tapered towards the nozzle, and the helical duct includes a terminal length which is radiused to the nozzle in a tapered manner;

wherein said helical duct is delimited internally or towards the longitudinal axis, by a cylindrical surface of a central tubular core having an axial central cavity for the passage of a fluid, and wherein an inner cylindrical surface of the outer body peripherally delimits the helical duct, a rigid body being fixed in the outer body and forming at least one helical channel providing a pair of facing helical surfaces, including an upper surface and a lower surface.

2. The injection head of claim 1, wherein the helical duct is radiused to the upper inlet in such manner that at the terminal length of the helical duct which is radiused, the longitudinal axis forms an acute angle not exceeding 30° with a straight line tangent to the central helical line of the helical duct.

3. The injection head of claim 1, wherein:

a) the radius of a helix of the helical duct is substantially constant or increases linearly or decreases linearly from the upper inlet to the outlet nozzle;

b) a helical pitch or a helix angle decreases constantly from the upper inlet to the outlet nozzle; and c) the area of a cross-section of the helical duct perpendicular to the central line decreases linearly from the upper inlet to the outlet nozzle.

4. The injection head of claim 1, wherein a central angle of a helix of the helical duct relative to the plane perpendicular to a central longitudinal axis at the upper inlet ranges between about 60° and less than 90°.

5. The injection head of claim 1, wherein a half-angle by which the helical duct is tapered is between about 5° and about 15°.

6. A head for injecting consolidating pressurised fluid mixtures into the ground to form consolidated soil portions, the head comprising:

an outer cylindrical body defining a central, longitudinal axis;

an upper inlet for receiving fluids from a string of tubular rods mountable above the head;

a side outlet nozzle lying in a plane substantially perpendicular to the longitudinal axis;

a helical duct defining a helical central line, the helical duct connecting the upper inlet to the nozzle to impart the fluid flowing through the helical duct a helical motion about the longitudinal axis towards the nozzle;

wherein the helical duct is progressively tapered towards the nozzle, and the helical duct includes a terminal length which is radiused to the nozzle in a tapered manner;

wherein:

the helical duct has a transverse rectangular shaped cross-section, the nozzle has a circular cross-section, and wherein in said terminal length, the helical duct is radiused to the nozzle by at least one deflector, the at least one deflector defining a polygonal inlet having a shape congruent to that of the rectangular shaped cross-section of the helical duct in a radiused point, a circular outlet congruent to that of the nozzle and an intermediate length passing gradually from the rectangular shaped cross-section to the circular cross-section.

7. The injection head of claim 6, wherein the at least one deflector is fixed or formed within the helical duct, immediately upstream of the nozzle, the at least one deflector having an arched surface facing the inside of the helical duct and suitable for deviating progressively the fluid flow from a peripheral zone, adjacent to a peripheral side surface of the helical duct, to a more central zone, wherein an end of the arched surface located more downstream is radiused uniformly to the upper inlet of the nozzle.

8. The injection head of claim 6, wherein the at least one deflector is made of a wear-resistant cemented carbide, tungsten carbide, or sintered materials.

9. A head for injecting consolidating pressurised fluid mixtures into the ground to form consolidated soil portions, the head comprising:

an outer cylindrical body defining a central, longitudinal axis;

an upper inlet for receiving fluids from a string of tubular rods mountable above the head;

a side outlet nozzle lying in a plane substantially perpendicular to the longitudinal axis;

a helical duct defining a helical central line, the helical duct connecting the upper inlet to the nozzle to impart the fluid flowing through the helical duct a helical motion about the longitudinal axis towards the nozzle;

wherein the helical duct is progressively tapered towards the nozzle, and the helical duct includes a terminal length which is radiused to the nozzle in a tapered manner;

wherein the helical shape of the helical duct is defined by a pair of facing helical surfaces, which include an upper surface and a lower surface, both the upper surface and the lower surface are formed by a rigid helical body secured within an inner cylindrical cavity of a sleeve constituting the outer cylindrical body.

10. The injection head of claim 9, further comprising sealing means interposed between an inner helical body and an inner surface of the sleeve.

11. The injection head of claim 9, wherein the at least one deflector comprises of a rigid arched element fixed within the helical duct, and having an outer cylindrical surface contacting an inner cylindrical surface of the sleeve, and wherein the at least one deflector gradually increases in thickness, in such manner that an arched inner surface starts from a thinner end portion, located more upstream in the helical duct, and terminates with a thicker end portion located more downstream, at the upper inlet of the nozzle.

* * * * *